United States Patent [19]

Alameddine et al.

[11] Patent Number: 4,733,726

[45] Date of Patent: Mar. 29, 1988

[54] METHOD OF IMPROVING THE AREAL SWEEP EFFICIENCY OF A STEAM FLOOD OIL RECOVERY PROCESS

[75] Inventors: Bassem R. Alameddine, Carrollton; Lloyd G. Jones, Dallas, both of Tex.

[73] Assignee: Mobil Oil Corporation, New York, N.Y.

[21] Appl. No.: 30,791

[22] Filed: Mar. 27, 1987

[51] Int. Cl.[4] ..... E21B 43/24; E21B 43/26

[52] U.S. Cl. ..... 166/263; 166/271; 166/272

[58] Field of Search ..... 166/263, 271, 272

[56] References Cited

U.S. PATENT DOCUMENTS

| | | | |
|---|---|---|---|
| 3,908,762 | 9/1975 | Redford | 166/263 |
| 4,130,163 | 12/1978 | Bombardierl | 166/263 X |
| 4,182,416 | 1/1980 | Trantham et al. | 166/263 X |
| 4,385,662 | 5/1983 | Mullins | 166/263 |
| 4,489,783 | 12/1984 | Shu | 166/263 X |
| 4,612,989 | 9/1986 | Rakach et al. | 166/263 |
| 4,635,720 | 1/1987 | Chew | 166/263 X |

*Primary Examiner*—George A. Suchfield
*Attorney, Agent, or Firm*—Alexander J. McKillop; Michael G. Gilman; Lawrence O. Miller

[57] ABSTRACT

A method for the recovery of oil from a subterranean, oil-containing formation by a cyclical steam flood-pressurization and production program. During the first cycle, steam is injected into the formation and oil is recovered until there is steam breakthrough at the production well. Thereafter, a pressurization cycle is initiated by throttling or shutting-in the production well while continuing injection of the steam until the bottomhole injection pressure is greater than the vertical pressure created by the overburden thereby causing the formation to fracture horizontally. After the horizontal fracture is formed, the third cycle or production cycle is initiated in which oil is recovered from the formation from either the production well or the injection well or both until the amount of oil recovered is unfavorable. Also, during the production cycle, if oil is recovered only from the injection well or the production well, steam may be injected into the nonproducing well until the amount of oil recovered is unfavorable. Thereafter, the steam flood, pressurization and production cycles may be repeated for a plurality of cycles until the production of oil is uneconomical. Optimum results of fracturing is obtained during the pressurization cycle when the bottomhole injection pressure is greater than 0.9 psi per foot of the true vertical pressure created by the overburden.

12 Claims, No Drawings

METHOD OF IMPROVING THE AREAL SWEEP EFFICIENCY OF A STEAM FLOOD OIL RECOVERY PROCESS

FIELD OF THE INVENTION

This invention relates to the recoveryof oil from a subterranean oil-containing formation, and more particularly to a new and improved thermal recovery method employing an alternate injection-pressurization and production cycle wherein the pressurization cycle is continued until the bottomhole injection pressure is greater than the vertical pressure created by the overburden.

BACKGROUND OF THE INVENTION

Many oil reservoirs have been discovered which contain vast quantities of oil but little or no oil has been recovered from many of them because the oil present in the reservoir is so viscous that it is essentially immobile at reservoir conditions and little or no petroleum flow will occur into a well drilled into the formation even if a natural or artificially induced pressure difrerential exists between the formatio and the well. Some form of supplemental oil recovery must be applied to these formations which decreases the viscosity of theoil sufficiently so that it will flow or that can be dispersed through the formation to a production well and therefrom to the surface of the earth. Thermal recovery techniques are quite suitable for viscous oil recovery and steam flooding is the most sucessful thermal oil recovery technique yet employed commercially.

Steam may be utilized for thermal stimulation for viscous oil production by means of a steam drive or steam throughput process in which steam is injected into the formation on a more or less continuous basis by means of an injection well and oil is recovered from the formation from a spaced-apart production well. One of the problems often associated with steam flooding is that sweep efficiency can be low unless very small flood patterns are used. This can occur because vertical fractures or other perferred pathways for flow channels are developed during the flooding process with the result that the steam or hot condensed water travels rapidly through the preferred flow channels causing water oil ratios and heat losses too high for economic production. The problem is caused by the vertical shape of the preferred path which limits the area available for heat transfer fromthe steam or hot water to the oil. In this invention an operating procedure is described which forces the preferred flow channel or pathway of the injected steam to be horizontal and to consequently have a much larger area available for heat transfer from steam or hot water to oil. The added efficiency in heating the oil permits greatly increased oil recovery.

SUMMARY OF THE INVENTION

The invention relates to an improved thermal method for recovering oil from a subterranean oil-containing formatio underlying an overburden that creates a vertical overburden pressure on the formation. The formation is penetrated by at least one injection well and at least one spaced-apart production well. In the first cycle, steam is injected into the formation through the injection well and fluids including oil are recovered from the formation through the production well until steam breakthrough occurs at the production well. Thereafter, a pressurization cycle is initiated wherein the production well is partially choked or shut-in while continuing to inject steam until the bottomhole injection pressure is greater than the true vertical pressure created by the overburden, preferably greater than 0.9 psi per foot of the vertical pressure created by the overburden, thereby causing the formation to fracture horizontally. Thereafter, injection of steam is discontinued and a production cycle is initiated wherein oil is recovered from the formation via the production well and injection well until the amount of oil recovered is unfavorable. Alternately, oil may be recovered from either the production well or the injection well or both until the amount of oil recovered is unfavorable. Alternately, during the production cycle if oil is recovered only from the injection well or production well, steam may be injected at a low rate into the nonproducing well. The steam injection, pressurization, and production cycles may be repeated for a plurality of cycles.

DESCRIPTION OF THE PREFERRED EMBODIMENTS

The process of our inventio is best applied to a subterranean oil-containing formation underlying an overburden that creates a vertical overburden pressure on the formation utilizing one or more injectio and production wells extending from the surface of the earth into the subterranean formation. The injection and production wells may be located and spaced-apart from one another in any desired pattern or orientation. For example, the line drive pattern may be utilized in which a plurality of injection wells and a plurality of production wells are arranged in rows which are spaced from one another. Exemplary of other patterns which may be used are those wherein a plurality of production wells are spaced about a central injection well or conversely a plurality of injection wells spaced around a central producing well. Typical of such well arrays are the five-spot, seven-spot, nine-spot, and thirteen-spot patterns. The above and other patterns for affecting secondary recovery are well known to those skilled in the art.

For the purpose of simplicity in describing the invention, reference sometimes will be made herein to only one injection well and one production well in a recovery pattern. However, it will be recognized in practical applications of the invention that a plurality of such wells, particularly the production wells, may be and in most cases will be utilized.

The process of our invention comprises a series of cycles, each cycle consisting of three parts. The first cycle is a steam flood comprising injecting steam into the formation through the injection well and recovering fluids including oil from the formation through the production well until there is steam breakthough at the production well. The steam being injected into the formation is saturated which simply means that there is present a liquid phase and a gaseous phase simultaneously at the point of injection. Ordinarily saturated steam is defined in terms of quality by specifying the weight fraction which is in the vapor phase. Thus, 80% quality steam means 80% of the steam on the basis of weight is vapor with the remaining 20% being liquid phase. It is generally satisfactory to use steam in the quality range from about 40 to 100%. Thereafter, a pressurization cycle is initiated by throttling or choking the production well while continuing injection of the steam into the formation without interrupting the injection rate until the bottomhole injection pressure is greater than the vertical pressure created by the overburden. Alternatively, the production well may be shut in during this step until the desired bottomhole pressure is obtained. Pressurization can be obtained by steam injection alone or by combining other fluids with steam either serially or concurrently. Once the formation pressure rises enough so that the bottomhole injection pressure is greater than the true vertical overburden pressure, preferably greater than 0.9 psi per foot of true vertical overburden pressure, the formation will part horizontally, normally at the top of the producing sand, and a horizontal fracture will occur which will permit subsequent injection of a flat layer of steam or hot water. The true vertical overburden pressure is determined by evaluating the density of the vertical column of rock and soil above the producing zone. The actual value will usually be in the range of 1 psi per foot of true vertical depth.

After the production well has remained choked or shut-in for the desired period of time and the horizontal fracture has been formed, the third cycle or production cycle is initiated in which the injection of steam is discontinued and the injection well and the production well are opened and oil is recovered from both wells until the amount of oil recovered is unfavorable. Alternatively, during the production cycle, oil may be recovered from either the production well or the injection well and the steam may be injected at a low rate into the nonproducing well until the amount of oil recovered is unfavorable. The three cycles of steam flooding, pressurization and production may be repeated for a plurality of cycles until oil recovery becomes uneconomical.

The formation of the horizontal fracture during the pressurization cycle provides a much greater surface area for heat transfer with the results that the viscous oil will be heated over a wide volume of the formation. The heated oil develops a much reduced viscosity and is therefore more easily flooded or pushed toward the production well by the hot water and steam thereby enhancing oil recovery.

The key element in our invention is in recognizing the necessity for obtaining injection pressures equal to or higher than the overburden pressure, thus permitting horizontal fracturing. The only reasonable means for doing this is over-injection which raises the average formation pressure. As the average formation pressure rises, the pressure required to obtain a vertical fracture increases (normally termed as increased fracture ingredient) until eventually the pressure required to obtain a vertical fracture exceeds the pressure required to obtain a horizontal fracture. At that point, a horizontal fracture occurs and the recovery mechanism changes from one dominated by vertical fracture flow to one dominated by heating from the top of the zone as dictated by the presence of the horizontal fracture. Therefore this invention provides a much larger area available for heat transfer from the steam or hot water to the viscous oil, thereby greatly increasing oil recovery.

From the foregoing specification one skilled in the art can readily ascertain the essential features of this invention and without departing from the spirit and scope thereof can adopt it to various diverse applications.

What is claimed is:

1. A method for recovering oil from a subterranean, oil-containing formation underlying an overburden that creates a vertical overburden pressure on said formation, said oil-containing formation penetrated by an injection well and a production well, the method comprising:

(a) injecting steam into the formation via the injection well and recovering fluids including oil from the formation via the production well until steam breakthrough occurs at the production well;

(b) throttling fluid flow from said production well and continuing injection of said steam without interrupting the injection rate until the bottomhole injection pressure is greater than the true vertical pressure created by the overburden thereby causing the formation to fracture horizontally; and (c) discontinuing injection of said steam and recovering oil from both said production well and said injection well until the amount of oil recovered is unfavorable.

2. The method of claim 1 further comprising repeating steps (a) through (c) for a plurality of cycles.

3. The method of claim 1 wherein said production well is shut-in during step (b).

4. The method of claim 1 wherein step (b) is continued until the bottomhole pressure is greater than 0.9 psi per foot of the true vertical pressure created by the formation.

5. A method for recovering oil from a subterranean, oil-containing formation underlying an overburden that creates a vertical overburden pressure on said formation, said oil-containing formation penetrated by an injection well and a production well, the method comprising:

(a) injecting steam into the formation via the injection well and recovering fluids including oil from the formation via the production well until steam breakthrough occurs at the production well;

(b) throttling fluid flow from said production well and continuing injectio of said steam without interrupting the injection rate until the bottomhole injection pressure is greater than the true vertical pressure created by the overburden thereby causing the formation to fracture horizontally; and (c) discontinuing injection of said steam and shutting in the injection well and recovering oil from the production well until the amount of oil recovered is unfavorable.

6. The method of claim 5 further comprising repeating steps (a) through (c) for a plurality of cycles.

7. A method for recovering oil from a subterranean, oil-containing formation underlying an overburden that creates a vertical overburden pressure on said formation, said oil-containing formation penetrated by an injection well and production well, the method comprising:

(a) injecting steam into the formation via the injection well and recovering fluids including oil from the formation via the production well until steam breakthrough occurs at the production well;

(b) throttling fluid flow from said production well and continuing injection of said steam without interrupting the injection rate until the bottomhole injection pressure is greater than the true vertical pressure created by the overburden thereby causing the formation to fracture horizontally; and (c) continuing to inject steam into the injection well at a low rate and recovering oil from the production well until the amount of oil recovered is unfavorable.

8. The method of claim 7 further comprising repeating steps (a) through (c) for a plurality of cycles.

9. A method for recovering oil from a subterranean, oil-containing formation underlying an overburden that creates a vertical overburden pressure on said formation, said oil-containing formation penetrated by an injection well and a production well, the method comprising:

(a) injecting steam into the formation via the injection well and recovering fluids including oil from the formation via the production well until steam breakthrough occurs at the production well;

(b) throttling fluid flow from said production well and continuing injection of said steam without interrupting the injection rate until the bottomhole injection pressure is greater than the true vertical pressure created by the overburden thereby causing the formation to fracture horizontally; and (c) injecting steam into the production well at a low rate and recovering oil from the injection well until the amount of oil recovered is unfavorable.

10. The method of claim 9 further comprising repeating steps (a) through (c) for a plurality of cycles.

11. A method for recovering oil from a subterranean, oil-containing formation underlying an overburden that creates a vertical overburden pressure on said formation, said oil-containing formation penetrated by an injection well and a production well, the method comprising:

(a) injecting steam into the formation via the injection well and recovering fluids including oil from the formation via the production well until steam breakthrough occurs at the production well;

(b) throttling fluid flow from said production well and continuing injection of said steam without interrupting the injection rate until the bottomhole injection pressure is greater than the true vertical pressure created by the overburden thereby causing the formation to fracture horizontally; and (c) discontinuing injection of said steam and shutting in the production well and recovering oil from the injection well until the amount of oil recovered is unfavorable.

12. The method of claim 11 further comprising repeating steps (a) through (c) for a plurality of cycles.

* * * * *

UNITED STATES PATENT AND TRADEMARK OFFICE

CERTIFICATE OF CORRECTION

PATENT NO. : 4,733,726

DATED : March 29, 1988

INVENTOR(S) : B.R. Alameddine and L.G. Jones

It is certified that error appears in the above—identified patent and that said Letters Patent is hereby corrected as shown below:

Column 1, line 7, "recoveryof" should be --recovery of--.
Column 1, line 23, "difrerential" should be --differential--.
Column 1, line 24, "formatio" should be --formation--.
Column 1, line 26, "theoil" should be --the oil--.

Column 1, line 49, "fromthe" should be --from the--.
Column 1, line 60, "formatio" should be --formation--.
Column 2, line 23, "inventio" should be --invention--.
Column 2, line 25, "injectio" should be --injection--.
Column 4, line 36, "injectio" should be --injection--.

Signed and Sealed this

Sixth Day of September, 1988

*Attest:*

*Attesting Officer*

DONALD J. QUIGG

*Commissioner of Patents and Trademarks*